US008006657B2

(12) United States Patent
Riley et al.

(10) Patent No.: US 8,006,657 B2
(45) Date of Patent: Aug. 30, 2011

(54) MODE-SWITCHING CAM FOLLOWER

(75) Inventors: William Riley, Livonia, MI (US); Mark Zagata, Livonia, MI (US); Michael Schrader, Canton, MI (US); Gregory McConville, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1269 days.

(21) Appl. No.: 11/566,133

(22) Filed: Dec. 1, 2006

(65) Prior Publication Data

US 2008/0127917 A1 Jun. 5, 2008

(51) Int. Cl.
*F01L 9/04* (2006.01)

(52) U.S. Cl. ..... 123/90.11; 123/90.27; 123/90.16

(58) Field of Classification Search ... 92/92; 123/90.11, 123/90.16, 90.27
See application file for complete search history.

(56) References Cited

U.S. PATENT DOCUMENTS

| | | | | |
|---|---|---|---|---|
| 4,608,208 | A | 8/1986 | Yogo et al. | |
| 6,321,705 | B1 | 11/2001 | Fernandez et al. | |
| 6,325,030 | B1 | 12/2001 | Spath et al. | |
| 6,375,638 | B2 * | 4/2002 | Nason et al. | 604/132 |
| 6,463,897 | B2 | 10/2002 | Fernandez et al. | |
| 6,467,445 | B1 | 10/2002 | Harris | |
| 6,604,498 | B2 | 8/2003 | Fernandez et al. | |
| 6,640,759 | B1 * | 11/2003 | Hendriksma | 123/90.16 |
| 6,830,019 | B2 | 12/2004 | Kluge | |
| 6,892,538 | B2 | 5/2005 | Park | |

FOREIGN PATENT DOCUMENTS

JP 2001173550 A * 6/2001

OTHER PUBLICATIONS

Abstract of JP2001173550.*

* cited by examiner

*Primary Examiner* — Zelalem Eshete
(74) *Attorney, Agent, or Firm* — Allan J. Lippa; Alleman Hall McCoy Russell & Tuttle LLP

(57) ABSTRACT

A mode-switching cam follower is disclosed, wherein the follower includes a body, a cam contact movably coupled to the body, and a latch member movably coupled to the body. A shape-memory alloy in communication with the latch member couples and decouples the latch member with the cam.

16 Claims, 8 Drawing Sheets

MODE-SWITCHING CAM FOLLOWER

BACKGROUND AND SUMMARY

Significant improvements in both fuel efficiency and performance of an internal combustion engine may be realized by selective switching of a cam profile. However, cam profile switching technologies have been difficult to implement in various valvetrain settings, such as roller finger follower valvetrains.

One method of implementing cam profile switching in a roller finger follower valvetrain has been to utilize a "drop finger" follower, wherein the roller finger is movably coupled to the follower body in such a manner that the finger can be operated in either a coupled mode, in which the roller finger is locked in position relative to the follower body, or in a decoupled mode, in which the roller finger is decoupled from and allowed to move relative to the follower body. This allows the cam and valve to have different lifts, depending upon whether the roller finger is coupled to or decoupled from the follower body.

One difficulty that has been encountered in implementing roller finger follower valve systems involves actuation of the roller finger decoupling mechanism. Both hydraulic and electromechanical actuation systems have been proposed. However, hydraulic systems may cause a power demand on the engine, as these systems require the oil pump to do additional work. Likewise, solenoids used in electromechanical systems may be relatively large and bulky.

The inventors herein have realized that the above-described problems may be addressed through the use of a mode-switching cam follower having a body, a cam contact movably coupled to the body, a latch member movably coupled to the body, wherein the latch member is movable between a coupled position in which the cam contact is held in a fixed relation to the body by the latch member and a decoupled position in which the cam contact is decoupled from the latch member and movable relative to the body, and an actuator in communication with the latch member, wherein the actuator comprises a shape memory alloy member. In some embodiments, the cam contact includes a roller finger, while in other embodiments includes a sliding contact. Such a mode-switching cam follower may allow actuation of the latch member while avoiding problems with the size and power demands found in other actuation systems.

DETAILED DESCRIPTION OF THE DEPICTED EMBODIMENTS

Figure 1:
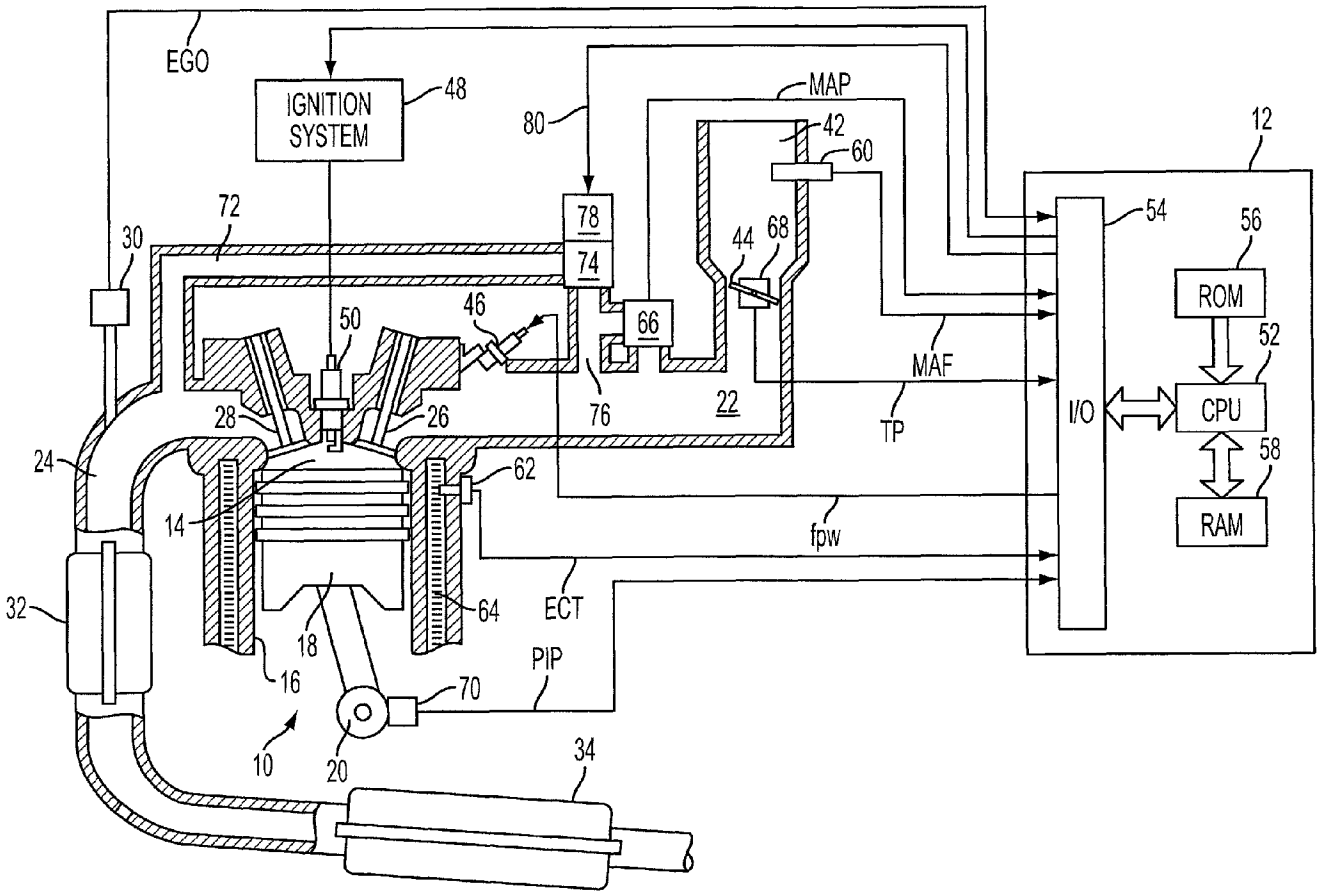
FIG. 1 shows an exemplary embodiment of an internal combustion engine.

FIG. 1 shows a schematic depiction of an exemplary embodiment of an internal combustion engine 10. Engine 10 is depicted as a port-injection spark-ignition gasoline engine. However, it will be appreciated that the systems and methods disclosed herein may be used with any other suitable engine, including direct-injection engines, and compression ignition engines including but not limited to diesel engines.

Engine 10 typically includes a plurality of cylinders, one of which is shown in FIG. 1, and is controlled by an electronic engine controller 12. Engine 10 includes a combustion chamber 14 and cylinder walls 16 with a piston 18 positioned therein and connected to a crankshaft 20. Combustion chamber 14 communicates with an intake manifold 22 and an exhaust manifold 24 via a respective intake valve 26 and exhaust valve 28. An exhaust gas oxygen sensor 30 is coupled to exhaust manifold 24 of engine 10. A catalyst 32, such as a three-way catalyst, is connected to and receives feedgas from exhaust manifold 24, and a $NO_x$ trap 34 is connected to and receives emissions from catalyst 32.

Intake manifold 22 communicates with a throttle body 42 via a throttle plate 44. Intake manifold 22 is also shown having a fuel injector 46 coupled thereto for delivering fuel in proportion to the pulse width of signal (fpw) from controller 12. Fuel is delivered to fuel injector 46 by a conventional fuel system (not shown) including a fuel tank, fuel pump, and fuel rail (not shown). Engine 10 further includes a conventional distributorless ignition system 48 to provide an ignition spark to combustion chamber 14 via a spark plug 50 in response to controller 12. In the embodiment described herein, controller 12 is a conventional microcomputer including: a microprocessor unit 52, input/output ports 54, an electronic memory chip 56, which may be electronically programmable memory, a random access memory 58, and a conventional data bus.

Controller 12 receives various signals from sensors coupled to engine 10, in addition to those signals previously discussed, including: measurements of inducted mass air flow (MAF) from a mass air flow sensor 60 coupled to throttle body 42; engine coolant temperature (ECT) from a temperature sensor 62 coupled to cooling jacket 64; a measurement of manifold pressure (MAP) from a manifold absolute pressure sensor 66 coupled to intake manifold 22; a measurement of throttle position (TP) from a throttle position sensor 68 coupled to throttle plate 44; and a profile ignition pickup signal (PIP) from a Hall effect sensor 70 coupled to crankshaft 40 indicating an engine speed (N).

Exhaust gas is delivered to intake manifold 22 by a conventional EGR tube 72 communicating with exhaust manifold 24, EGR valve assembly 74, and EGR orifice 76. Alternatively, tube 72 could be an internally routed passage in the engine that communicates between exhaust manifold 24 and intake manifold 22.

As described above, valves 26 and 28 may be operated by the combination of one or more camshafts and a mode-switching follower, such as a drop finger follower. One type of drop finger follower, which may be referred to as a roller finger follower, includes one or more rollers mounted to a follower body (such as a rocker arm), wherein a cam lobe on the camshaft contacts the roller. The roller may be configured to be selectively coupled to or decoupled from the follower body. In the coupled operating mode, the roller is locked in position relative to the follower body, whereas in the decoupled operating mode, the roller is allowed to float in position relative to the follower body. This allows the valve operating to be varied without adjusting the camshaft. Furthermore, multiple rollers may be mounted to the follower body, thereby allowing different profile cams to be used to operate a valve by selectively coupling and decoupling rollers to/from the follower body. This allows valve lift and timing to be controlled.

As mentioned above, problems have been encountered with hydraulic and electromechanical actuation systems for operating the drop finger decoupling mechanism. For example, hydraulic systems may cause a power demand on the engine due to the work performed by the oil pump in providing hydraulic power. Likewise, solenoids used in electromechanical systems may be large and bulky, and therefore difficult to use with many engines.

Figure 2:
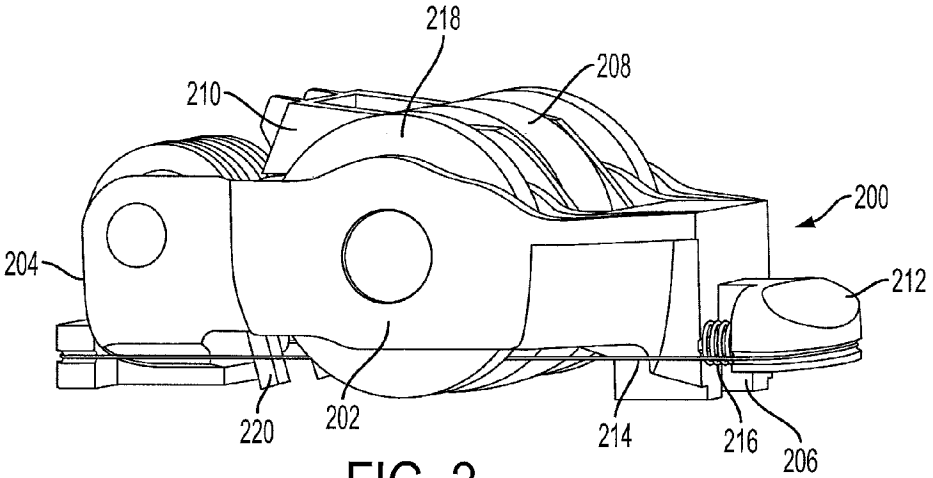
FIG. 2 shows a view of an exemplary embodiment of a mode-switching roller finger follower.
Figure 4:
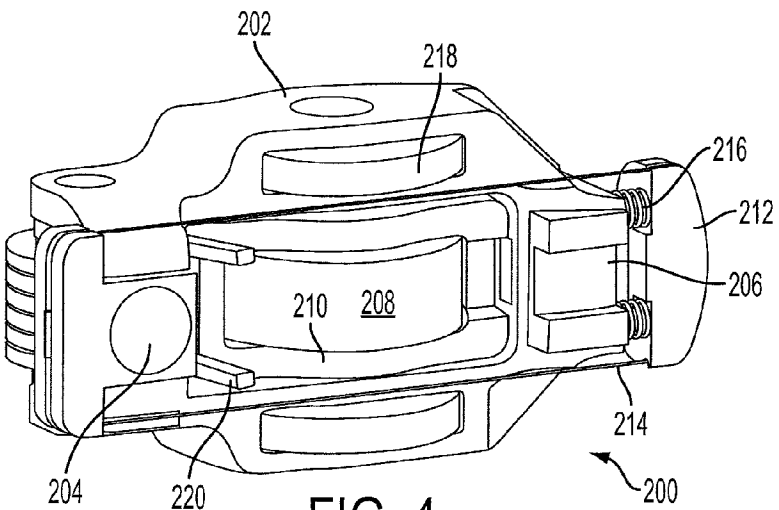
FIG. 4 shows a view of the embodiment of FIG. 2 in a disengaged mode.
Figure 3:
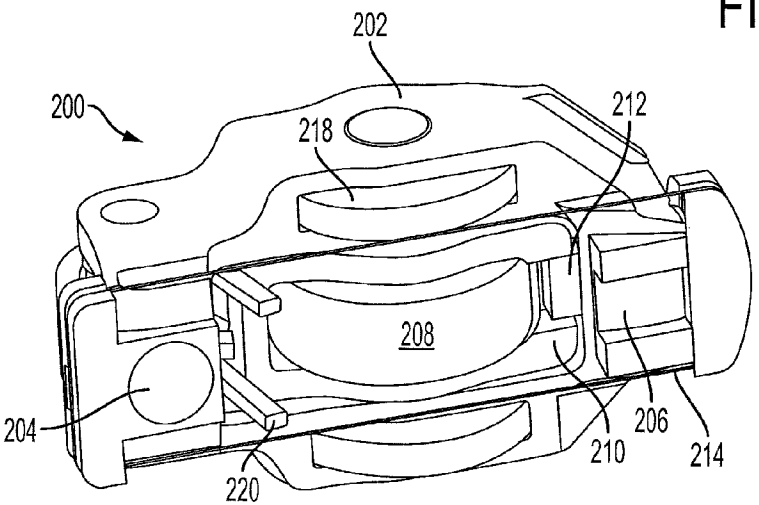
FIG. 3 shows a view of the embodiment of FIG. 2 in an engaged mode.

FIGS. 2-4 show an exemplary embodiment of a roller finger follower having an actuation system that may overcome such problems with hydraulic and solenoid-based actuation systems. Referring first to FIG. 2, roller finger follower 200 includes a rocker arm 202 having a lash adjuster ball socket 204 adjacent one end of the rocker arm and a valve stem contact 206 adjacent an opposing end. Rocker arm 202 further includes a mode-switching roller 208 switchable between a coupled operating mode and a decoupled operating mode. In the depicted embodiment, mode-switching roller 208 is coupled to rocker arm 202 via a roller frame 210 disposed within an opening of rocker arm 202. Roller 208 rotates within roller frame 210, while roller frame 210 holds roller 208 in either a fixed or floating relation to rocker arm 202, depending upon operating mode. While the depicted embodiment shows roller 208 coupled to rocker arm 202 via roller frame 210, it will be appreciated that roller 208 may be coupled to rocker arm 202 in any other suitable manner.

Roller finger follower 202 further comprises a latch member 212 which is selectively engageable with roller frame 210. Engaging latch member 212 with roller frame 210 places roller finger follower 200 in the coupled mode, as shown in FIG. 3, while disengaging latch member 212 from roller frame 210 places roller finger follower 200 in the decoupled mode, as shown in FIG. 4.

Roller finger follower 202 further includes an actuator 214 formed from a shape memory alloy wire. Shape memory alloys are materials that undergo a dimension-changing phase transition upon a temperature change, and that return to the "original" geometry upon a reverse temperature change. The length of the shape memory alloy wire may be changed simply by controlling an electrical current through the wire to control a resistive heating of the wire. In this manner, the use of actuator 214 may allow the operating mode of roller finger follower 202 to be effectively controlled without the disadvantages encountered with hydraulic and electromechanical actuators.

Any suitable shape memory alloy material may be used as actuator 214. Examples of suitable materials may include, but are not limited to, shape memory alloys with the following elemental combinations: Ag—Cd, Cu—Al—Ni, Cu—Sn, Cu—Zn, Cu—Zn—X (X=Si, Sn, Al), In—Ti, Ni—Al, Ni—Ti, Fe—Pt, Mn—Cu, Fe—Mn—Si, Ti—Ni—V, Ni—Ti—Cr, Ni—Ti—Fe, Ni—Ti—Cu various Pt alloys, Co—Ni—Al, and Co—Ni—Ga.

Shape memory alloy actuator 214 may be coupled to latch member 212 and rocker arm 202 in any suitable manner. In the depicted embodiment, shape memory wire actuator 214 extends substantially around an outer circumference of latch member 212 and ball socket 204, and along an underside of rocker arm 202. Therefore, with materials that undergo a contracting phase change when heated, application of a current through shape memory alloy wire actuator 214 may cause the length of the wire to contract, pulling latch member 212 from a decoupled configuration into a coupled configuration. Likewise, the cessation of current through the actuator may cause shape memory alloy actuator 214 to cool and expand, thereby allowing latch member 212 to move from a coupled configuration to a decoupled configuration. One or more springs 216 may be provided biasing latch member 212 toward the decoupled position. Furthermore, additional cooling may be provided via forced air, engine oil, or other engine coolant. When latch member 212 is in a decoupled mode, roller 208 may be displaced relative to rocker arm 202 by the corresponding cam lobe such that motion of the cam lobe is not transferred to the valve. In this mode, alternate rollers 218 may interact with corresponding alternate cam lobes on the camshaft (not shown) to allowing the use of an alternate valve lift and/or timing. Furthermore, a spring 220 may be provided to bias roller 208 toward a default position while in the decoupled mode.

While the depicted actuator 214 takes the form of a wire extending substantially around a lengthwise perimeter of roller finger follower 202, it will be appreciated that actuator 214 may be coupled to rocker arm 202 in any other suitable manner. Furthermore, while the depicted actuator 214 includes a single length of wire, it will be appreciated that a shape memory alloy actuator may also include more than one wire. For example, such an actuator may include two or more wires arranged in a parallel bundle, in series, or in any other suitable geometric relation.

It will be appreciated that the physical properties of the alloy and the structure of roller finger follower 200 may be factors to be considered in the specific design of actuator 214. For example, different alloys may have different electrical, mechanical and thermal properties, including but not limited to phase transition temperatures, coefficients of expansion, electrical conductivities, etc. These and other properties may affect the design of a specific embodiment of actuator 214, including but not limited to the length, diameter, and other geometrical aspects of actuator 214, as well as where and how the actuator is coupled to the follower.

Figure 5:
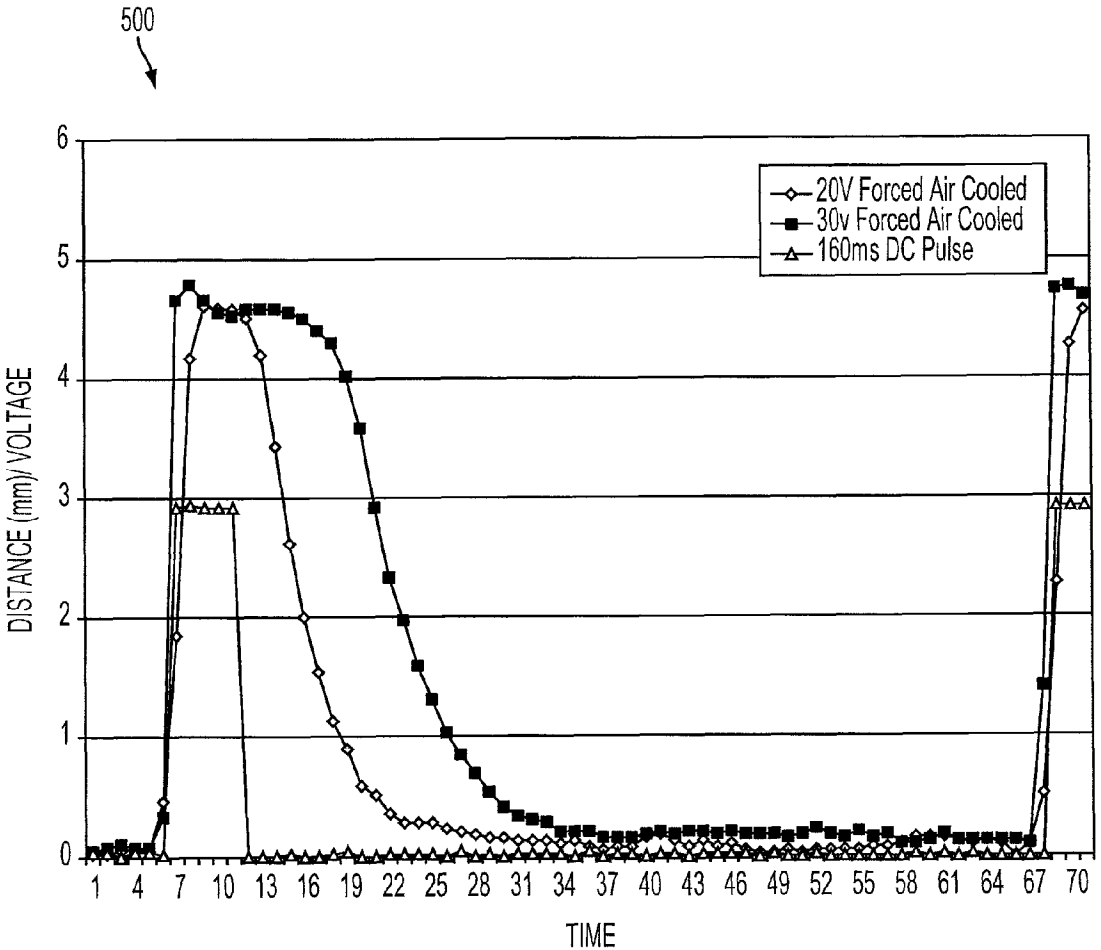
FIG. 5 shows a graphical representation of a change in length of a shape memory alloy wire as a function of time and applied voltage.

Another consideration in the design of shape memory alloy actuator 214 may be the desired actuator response time between controller 12 directing actuation and actuator 214 undergoing a phase change. For example, the current and/or voltage applied to shape memory actuator may effect the response time. FIG. 5 shows a graphical representation of a response of an exemplary shape memory alloy wire as a function of time for different activation voltages. To produce this data, DC pulses of 160 milliseconds in duration were applied to a shape memory alloy at a voltage of 20 V and at a voltage of 30 V, and forced air cooling was used to cool the wire. From this figure, it can be seen that the 20 V pulse heated the shape memory alloy wire slightly more slowly than the 30 V pulse, but allowed the wire to cool substantially more quickly than the 30 V pulse.

In some embodiments, a pulse having multiple voltage levels may be used. For example, a higher voltage portion of the pulse may be used initially to cause the shape memory alloy actuator to heat quickly, and then a lower voltage may be used to maintain the shape memory alloy actuator in the higher temperature phase. Removal of the lower voltage pulse may then allow the shape memory alloy wire to cool more quickly than if a voltage pulse of a single, higher voltage is used. In other embodiments, three or even more voltage levels may be used. In yet other embodiments, a duty cycle of the signal applied to shape memory alloy actuator 214 may be adjusted to control the temperature of actuator 214.

Figure 6:
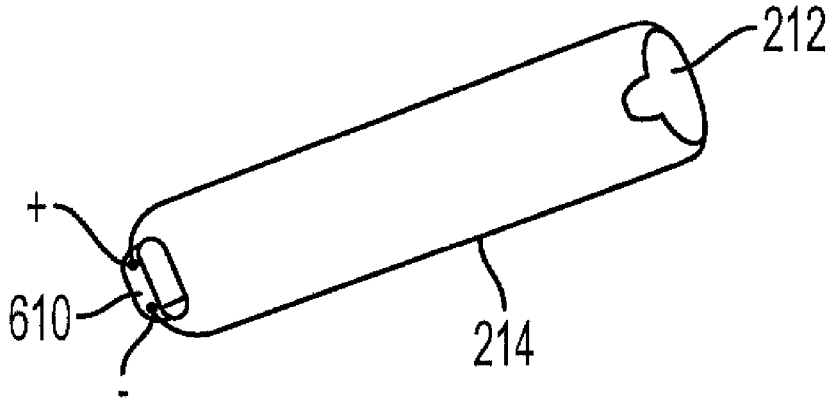
FIG. 6 shows a schematic depiction of a first electrical connection configuration for the embodiment of FIG. 2.
Figure 7:
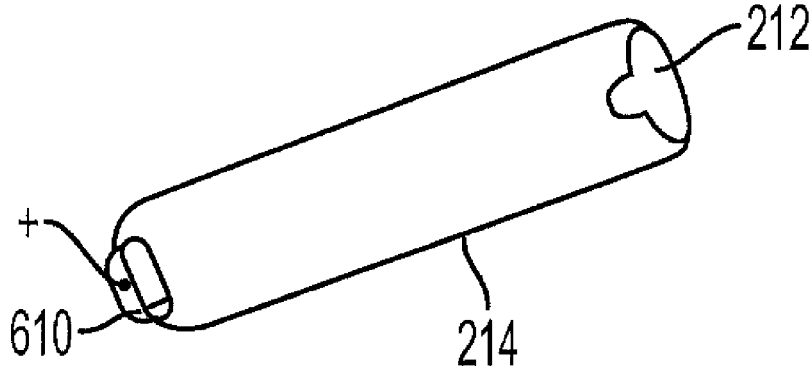
FIG. 7 shows a schematic depiction of a second electrical connection configuration for the embodiment of FIG. 2.

Shape memory alloy actuator 214 may include any suitable configuration of electrical connections for connecting the actuator to a power supply. Two possible examples are shown in FIGS. 6 and 7. First referring to the embodiment of FIG. 6, latch member 212 is formed from, coated with, or otherwise includes an insulating material that is in contact with shape memory actuator 214. Likewise, an insulator block 610 may also be provided adjacent the lash adjuster ball socket (not shown in FIG. 6). In this manner, shape memory alloy actuator 214 is electrically insulated from structures on roller finger follower 200.

Electrical leads may be provided at each end of actuator 214. In the embodiment depicted in FIG. 6, the leads of actuator 214 are disposed adjacent insulator block 610. This portion of roller finger follower 200 moves less than other portions of follower 200 when displaced by a cam lobe, and therefore may be a more robust location for electrical contacts. Alternatively the leads of actuator 214 may be located adjacent latch member 212, or at any other suitable location.

FIG. 7 shows an exemplary embodiment of an alternate electrical configuration for shape memory alloy actuator 214. In this embodiment, one contact is disposed at insulator block 610 and the other contact is at latch member 212. In this embodiment, current may flow in parallel along each side 710, 712 of actuator 214 between the contacts. Also, the contact at latch member 212 may be electrically connected to latch member 212 to provide a ground path to the engine. In alternate embodiments, actuator 214 may be electrically connected to rocker arm 202 or any other suitable grounding location on follower 200. It will be appreciated that the electrical configurations shown in FIGS. 6 and 7 are merely exemplary, and that any other suitable electrical configuration may be used.

Figure 8:
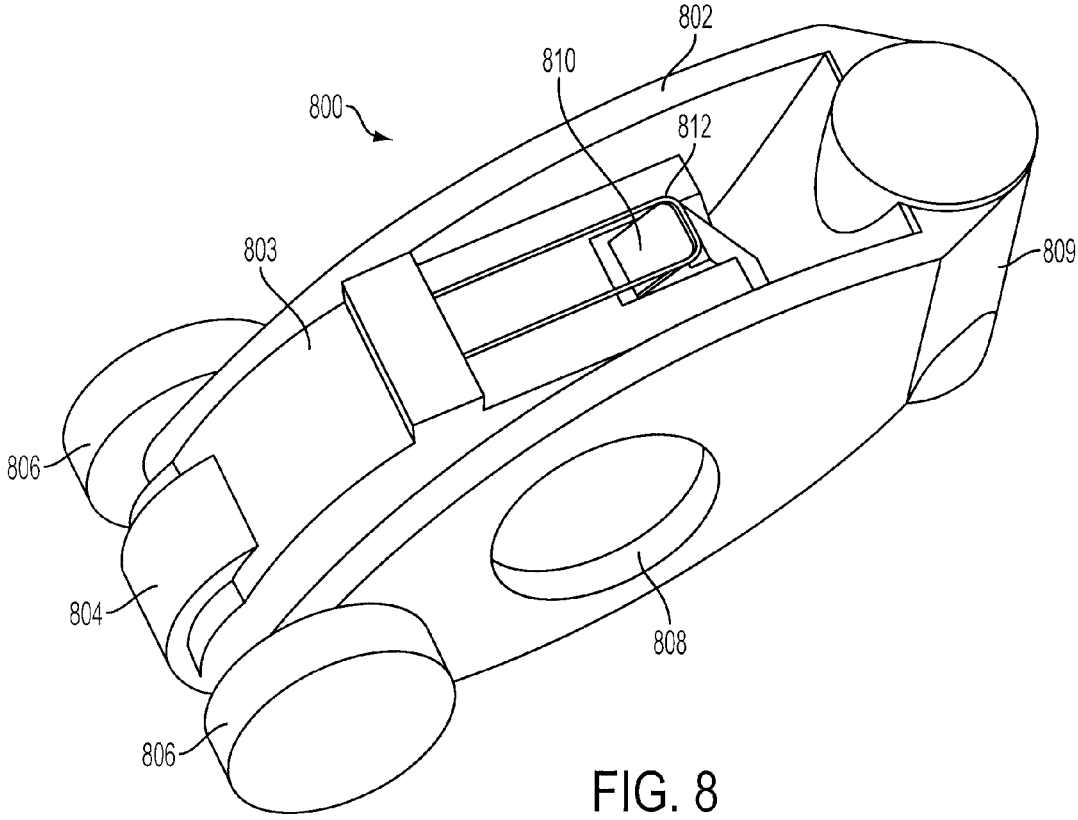
FIG. 8 shows a perspective view of a second embodiment of a mode-switching cam follower.
Figure 9:
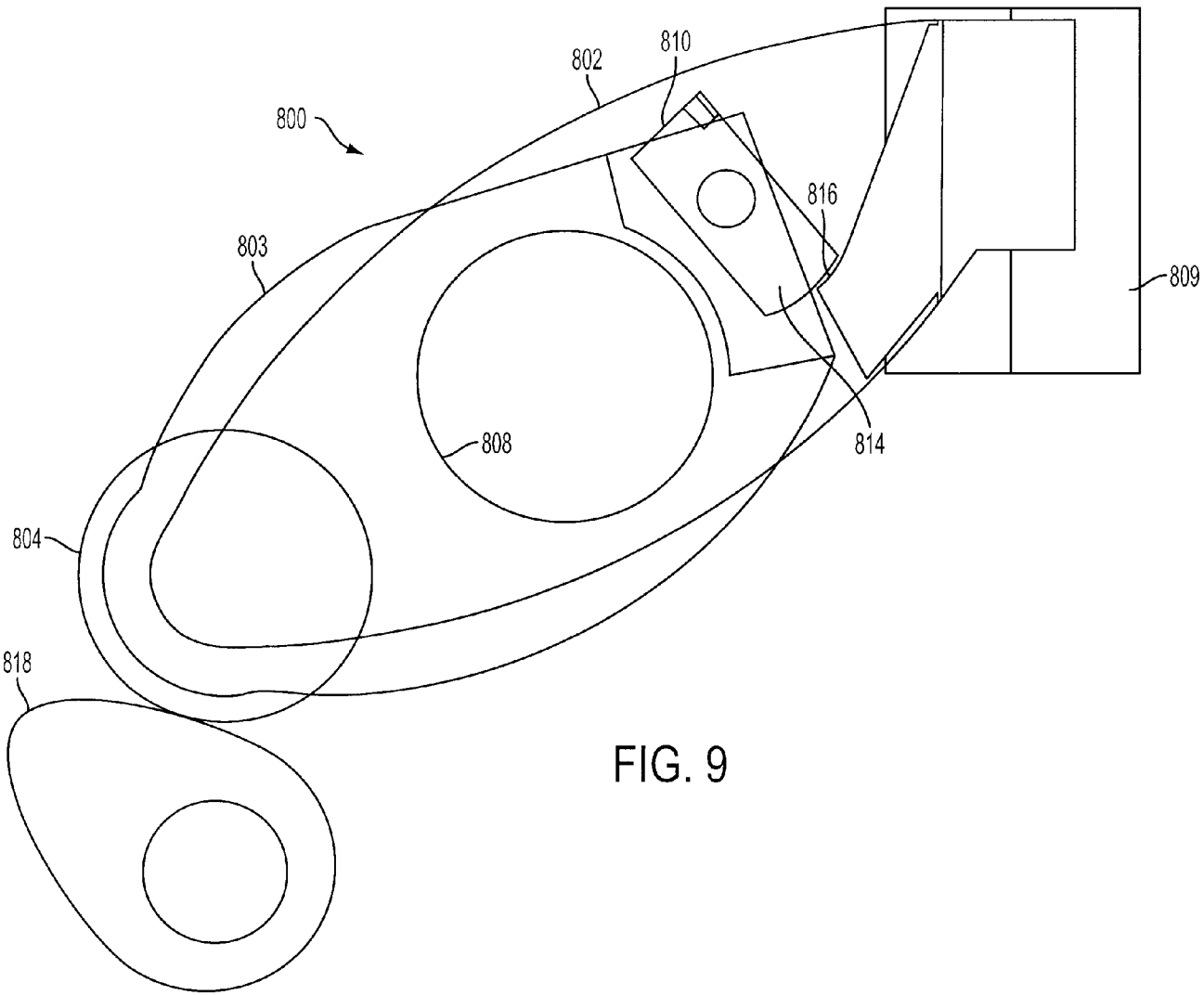
FIG. 9 shows a schematic depiction of the embodiment of FIG. 8 in an engaged mode.
Figure 10:
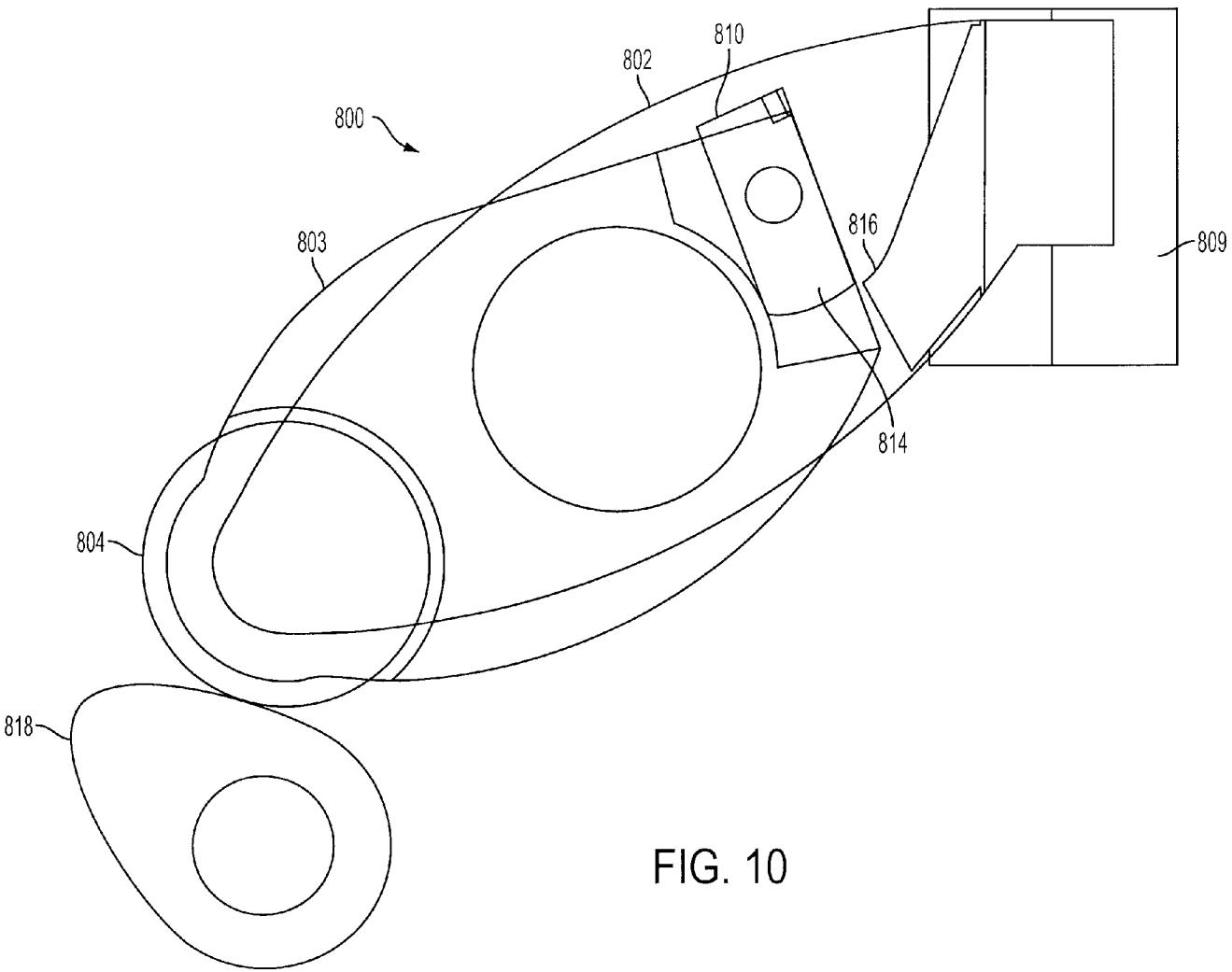
FIG. 10 shows a schematic depiction of the embodiment of FIG. 8 in a disengaged mode.

FIGS. 8-10 show schematic depictions of an alternate embodiment of a mode-switching roller finger follower having a shape memory alloy actuator. Various structural elements of this embodiment, such as the rocker shaft, are omitted from these figures to more clearly illustrate the actuator mechanism. Referring first to FIG. 8, roller finger follower 800 includes a rocker arm 802 and a drop member 803 disposed within rocker arm 802. A primary roller 804 is coupled to drop member 803, and one or more secondary rollers 806 are coupled to rocker arm 802. A rocker shaft bore 808 is defined through rocker arm 802. Rocker arm 802 and drop member 803 each may pivot on a rocker shaft (not shown) that extends through rocker bore 808. Roller finger follower 800 further includes a valve stem attachment portion 809 to which a valve stem may be coupled, for example, via a lash adjuster.

Continuing, a latch member 810 is pivotally coupled to drop member 803, and a shape memory alloy actuator 812 is coupled to latch member 808. Actuator 812 extends around latch member 808, and is coupled to drop member 803 at a location intermediate the length of roller drop member 803 and rocker arm 802.

Referring next to FIGS. 9-10, latch member 810 is configured to pivot such that, in the coupled mode (FIG. 9), an end 814 of latch member 810 extends over a complementary latching surface 816 on rocker arm 802. In this operating mode, motion transferred to drop member 803 by a cam lobe 818 will be transferred to rocker arm 802 to cause valve opening. Likewise, in the decoupled mode (FIG. 10), end 814 of latch member 812 does not extend over latching surface 816. In this operating mode, drop member 803 does not transfer motion from cam lobe 818 to rocker arm 802, but instead pivots freely of rocker arm 802. Therefore, the motion of drop member 803 does not cause valve opening. The decoupled mode may be configured either to provide a different lift and/or timing than the coupled mode (for example, via the use of a secondary cam lobe that operates secondary rollers 806), or may be configured to act as a valve shutoff mode.

Figure 11:
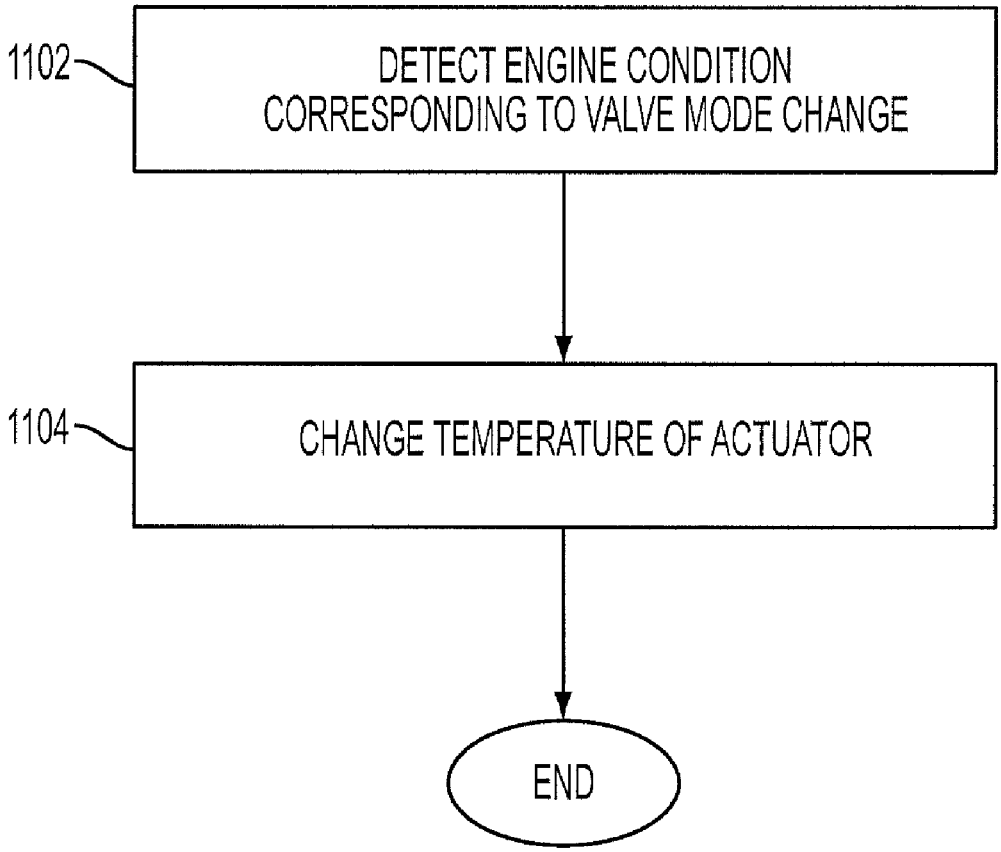
FIG. 11 shows a flow diagram of an exemplary embodiment of a method of operating a mode-switching cam follower.

FIG. 11 shows an exemplary embodiment of a method 1100 of operating a mode-switching cam follower. Method 1100 includes, at 1102, detecting an engine operating condition corresponding to a change in valve operating mode, and then at 1104, changing a temperature of a shape memory alloy actuator to actuate a change in valve operating mode.

Any suitable engine operating condition or change in engine operating condition may trigger actuation of a change in valve operating mode. For example, engine operating conditions that may trigger a change in valve operating mode to a decoupled mode (wherein valve lift is reduced, or even shut off) include, but are not limited to, detecting a decrease in engine torque.

Likewise, engine operating conditions that may trigger a change in valve operating mode to a coupled mode (wherein valve lift is increased or restored) include, but are not limited to, detecting an increase in engine torque.

Referring next to step 1104, the temperature of the shaped memory alloy actuator may be changed in any suitable manner. For example, the temperature of the shaped memory alloy may be increased by applying a voltage pulse across the alloy, thereby causing an electric current to flow through the alloy. The voltage pulse may have any suitable magnitude, and may have either a constant value, or a value that changes over time. For example, a higher initial voltage may be used to heat the alloy rapidly, and then a lower voltage may follow the higher initial voltage to maintain the alloy in the high-temperature phase for the desired duration and yet to permit more rapid cooling of the alloy upon cessation of the voltage pulse. Furthermore, the temperature of the alloy may also be increased by increasing a duty cycle of a signal applied across the alloy.

Likewise, the temperature of the shape memory alloy actuator may be decreased by lowering the voltage applied across the alloy, including lowering the voltage to approximately zero, or by decreasing a duty cycle of the signal applied across the alloy. Furthermore, cooling of the alloy may be assisted by exposing the alloy to a coolant such as forced air, engine oil or other engine coolant.

While the concepts disclosed herein are depicted and described in the context of roller finger followers, it will be appreciated that a mode-switching follower incorporating any of the features disclosed herein may have any other suitable cam contact than a roller, including but limited to sliding contacts. Furthermore, while the embodiments depicted herein show exemplary embodiments of roller finger followers each configured to be switched from a decoupled mode to a coupled mode when the shape memory alloy actuator decreases in dimension, it will be appreciated that an actuator may also be configured to be switched from a coupled mode to a decoupled mode by a decrease in actuator dimension.

Furthermore, it will be appreciated that the various embodiments of mode-switching roller finger followers disclosed herein are exemplary in nature, and these specific embodiments are not to be considered in a limiting sense, because numerous variations are possible. The subject matter of the present disclosure includes all novel and non-obvious combinations and subcombinations of the various features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the various features, functions, elements, and/or properties disclosed herein may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A cam follower, comprising:

a cam contact movably coupled to a body;

a latch member movably coupled to the body and movable between a coupled position with the latch member holding the cam contact fixed to the body and a decoupled position with the cam contact decoupled from the latch member and movable relative to the body; and a shape-memory alloy wire coupled around an outer latch member circumference and along a body underside.

2. The cam follower of claim 1, wherein the shape-memory alloy wire comprises a plurality of shape-memory alloy wires.

3. The cam follower of claim 1, wherein the shape-memory alloy wire comprises first and second ends, further comprising electrical connections in communication with each of the first and second ends of the shape-memory alloy wire.

4. The cam follower of claim 3, wherein the shape-memory alloy wire is electrically connected to the body.

5. The cam follower of claim 3, wherein the shape-memory alloy wire is electrically connected to the latch member.

6. An apparatus comprising an internal combustion engine, the internal combustion engine comprising a mode-switching roller finger follower, the roller finger follower comprising:

rocker arm;

a drop member disposed within the rocker arm;

a roller coupled to the drop member;

a latch member pivotally coupled to the drop member and configured to pivot between a coupled position in which the roller is held in a fixed relation to the rocker arm by the latch member and a decoupled position in which the roller is decoupled from the latch member and movable relative to the rocker arm; and a shape-memory alloy wire extending around the latch member and coupled to the drop member at a location intermediate a length of the drop member and the rocker arm cause the latch member to move between the coupled position and the decoupled position when the shape-memory alloy wire undergoes a phase transition.

7. The roller finger follower of claim 6, wherein the shape-memory alloy wire extends over a complementary latching surface on the rocker arm in the coupled position and does not extend over the complementary latching surface in the decoupled position.

8. The roller finger follower of claim 6, wherein the shape-memory alloy wire comprises a plurality of shape-memory alloy wires.

9. The roller finger follower of claim 6, further comprising electrical connections in communication with the shape memory shape-memory alloy wire.

10. The roller finger follower of claim 9, wherein the shape-memory alloy wire is electrically connected to the rocker arm.

11. The roller finger follower of claim 9, wherein the shape-memory alloy wire is electrically connected to the latch member.

12. The roller finger follower of claim 9, further comprising a rocker shaft on which the roller finger follower pivots, and wherein the electrical connections to the shape-memory alloy wire are disposed adjacent to the rocker shaft.

13. In an apparatus having an internal combustion engine, wherein the engine comprises a controller, at least one cylinder comprising a valve, and a cam follower for operating the valve, the cam follower comprising a body, a cam contact movably coupled to the body, a latch member movably coupled to the body and selectively movable to hold the cam contact in a fixed relation to the body, and a latch member actuator comprising a shape-memory alloy, a method of operating the engine, comprising:

detecting an engine operating condition corresponding to a change in a valve operating mode; and applying a higher initial voltage to the shape-memory alloy, the shape-memory alloy extending substantially around an outer circumference of the latch member, during initial heating of the shape-memory alloy to rapidly increase temperature and cause the shape-memory alloy to pull the latch member to hold the cam contact in a fixed relation to the body, and then maintaining the temperature at an increased level by applying a smaller voltage to the shape-memory alloy; and ceasing application of the smaller voltage to cool the shape-memory alloy.

14. The method of claim 13, further comprising cooling the shape-memory alloy with forced air after ceasing application of the smaller voltage.

15. The method of claim 13, further comprising cooling the shape-memory alloy with an engine fluid after ceasing application of the smaller voltage.

16. The method of claim 15, wherein the engine fluid comprises engine oil.

* * * * *